US005598826A

United States Patent [19]

Hunt et al.

[11] Patent Number: 5,598,826

[45] Date of Patent: Feb. 4, 1997

[54] COLD START FUEL CONTROL SYSTEM FOR AN INTERNAL COMBUSTION ENGINE

[75] Inventors: Frank W. Hunt, White Lake; Toshiharu Nogi, Novi, both of Mich.

[73] Assignee: Hitachi America, Ltd., Tarrytown, N.Y.

[21] Appl. No.: 465,229

[22] Filed: Jun. 5, 1995

Related U.S. Application Data

[63] Continuation-in-part of Ser. No. 364,893, Dec. 27, 1994.

[51] Int. Cl.[6] ..... F02M 51/00

[52] U.S. Cl. ..... 123/491; 123/545; 123/179.7

[58] Field of Search ..... 123/491, 545, 123/179.7, 472, 179.21

[56] References Cited

U.S. PATENT DOCUMENTS

| | | | |
|---|---|---|---|
| 3,827,417 | 8/1974 | Morita | 123/179.7 |
| 4,503,833 | 3/1985 | Yunick | 123/545 |
| 4,928,642 | 5/1990 | Atkinson et al. | 123/179.7 |
| 5,146,897 | 9/1992 | Hattori et al. | 123/545 |
| 5,225,456 | 7/1993 | Hosoda et al. | 123/491 |
| 5,394,857 | 3/1995 | Yamakawa | 123/491 |

*Primary Examiner*—Raymond A. Nelli

*Attorney, Agent, or Firm*—Gifford, Krass, Groh, Sprinkle, Patmore, Anderson & Citkowski, P.C.

[57] ABSTRACT

A cold start fuel control system provided for use with an internal combustion engine of the type having at least one combustion chamber, an air/fuel passageway fluidly connected with the combustion chamber and the source of fuel. The fuel control system includes an annular heater having an interior annular wall disposed within the passageway. A cold start fuel injector has its inlet fluidly connected to the fuel source and an outlet open to the passageway such that fuel from the outlet flows into the interior of the heater. Whenever the operating temperature of the engine is below a predetermined level, fuel is selectively provided to the cold start fuel injector which injects fuel into the passageway. The fuel discharge from the cold start fuel injector is swirled so that at least a portion of the fuel from the cold start fuel injector impinges upon the annular heater and is thus vaporized.

21 Claims, 8 Drawing Sheets

122
TEMP.
124
16
ECU
12
110
112
36
10
120
18
10
10
44
114
34
40

COLD START FUEL CONTROL SYSTEM FOR AN INTERNAL COMBUSTION ENGINE

This is a continuation-in-part of copending application Ser. No. 08/364,893 filed on Dec. 27, 1994.

BACKGROUND OF THE INVENTION

1. Field of the Invention

The present invention relates generally to fuel control systems for internal combustion engines and, more particularly, to a cold start fuel control system.

2. Description of the Prior Art

Most modern day internal combustion engines of the type used in automotive vehicles include a plurality of internal combustion chambers. An intake manifold has one end open to ambient air and its other end open to the internal combustion chambers via the engine intake valves. During a warm engine condition, a multipoint fuel injector is associated with each of the internal combustion engines and provides fuel to the internal combustion engines. The activation of each multipoint fuel injector is typically controlled by an electronic control unit (ECU).

During a cold start engine condition, however, a single cold start fuel injector is often times provided to supply fuel to the air intake manifold to the engine. The single cold start fuel injector injects sufficient fuel into the air/fuel intake passageway to provide fuel for all of the cylinders of the engine during engine warmup. As the engine warms up, the cold start fuel injector is gradually deactivated while, simultaneously, the multipoint fuel injectors are gradually activated in order to provide a smooth transition between the cold start fuel injector and the multipoint fuel injectors.

In order to ensure engine start-up during a cold engine condition, it has also been the previous practice for the cold start fuel injector to inject sufficient fuel into the engine in order to achieve a rich air/fuel mixture having a ratio in the range of 10:1 to 14:1. Even though such a rich air/fuel ratio is sufficient to ensure proper starting of the engine during cold starting conditions, the overly rich air/fuel ratio produces a relatively high amount of undesirable engine emissions, such as hydrocarbon and nitrous oxide emissions.

Such an overly rich air/fuel mixture has previously been required to ensure that there is sufficient fuel vapor within the internal combustion engine to ensure engine starting. Such vaporization of fuel is more difficult to attain during a cold start condition than a warm engine condition since the fuel is not vaporized by contacting hot portions of the engine, such as the intake manifold and internal combustion chambers.

While the previously known cold start fuel control systems have been sufficient to ensure proper starting of the engine while meeting prior governmental regulations, such systems are inadequate to meet the proposed future governmental regulations relating to exhaust emissions from automotive vehicles. For example, a United States emission regulations for CO, HC/NMOG and $NO_2$ for the year 1991 are 7.0, 0.39 and 0.40 grams/mile respectively. For the model year 1997, the corresponding levels must be reduced to 1.7, 0.040 and 0.20 grams/mile respectively.

SUMMARY OF THE PRESENT INVENTION

The present invention provides a cold start fuel control system for an internal combustion engine which overcomes all of the above-mentioned disadvantages of the previously known systems.

In brief, the cold start fuel control system of the present invention is utilized with an internal combustion engine of the type having at least one internal combustion chamber and an air/fuel passageway fluidly connected with the combustion chamber, typically via an intake manifold. The air/fuel passageway is disposed in either the main air/fuel passageway for the engine, or an idle bypass passageway.

An annular heater having an internal annular wall is disposed within the passageway. During the operation of the cold start system, the annular heater is maintained at an elevated temperature sufficient to vaporize fuel. Typically, this temperature is in the range of 160° C.

A cold start fuel injector has its inlet fluidly connected to a fuel source and its outlet open to the passageway. Upon activation, the cold start fuel injector injects fuel into the passageway. Furthermore, preferably the cold start fuel injector injects fuel in an outwardly flared pattern such that the fuel impinges upon the interior annular wall of the heater.

In order to enhance the intermixing of fuel with the air as the fuel is injected from the cold start fuel injector, the air is swirled in the passageway immediately downstream from the cold start fuel injector. This swirling action of the air flow centrifugally forces the fuel droplets from the cold start fuel injector against the heater wall thus vaporizing the fuel in the desired fashion. Furthermore, this swirling action of the air flow in the passageway can be achieved by providing fins in the passageway, tangentially injecting air flow into the passageway downstream from the cold start fuel injector as well as other ways.

In a still further embodiment of the invention, the air passageway is connected to the intake manifold. A secondary heater is then provided within the intake manifold in alignment with the passageway. This secondary heater serves to complete the vaporization of any fuel droplets which are not vaporized by the primary annular heater.

The cold start fuel control system of the present invention ensures almost complete vaporization of the fuel prior to the fuel reaching the internal combustion chambers. Such complete vaporization enables near stoichiometric air/fuel ratios to be employed with the cold start fuel system thereby reducing undesirable emissions.

BRIEF DESCRIPTION OF THE DRAWING

A better understanding of the present invention will be had upon reference to the following detailed description, when read in conjunction with the accompanying drawing, wherein like references refer to like pans throughout the several views, and in which.

DETAILED DESCRIPTION OF PREFERRED EMBODIMENTS OF THE PRESENT INVENTION

Figure 1A:
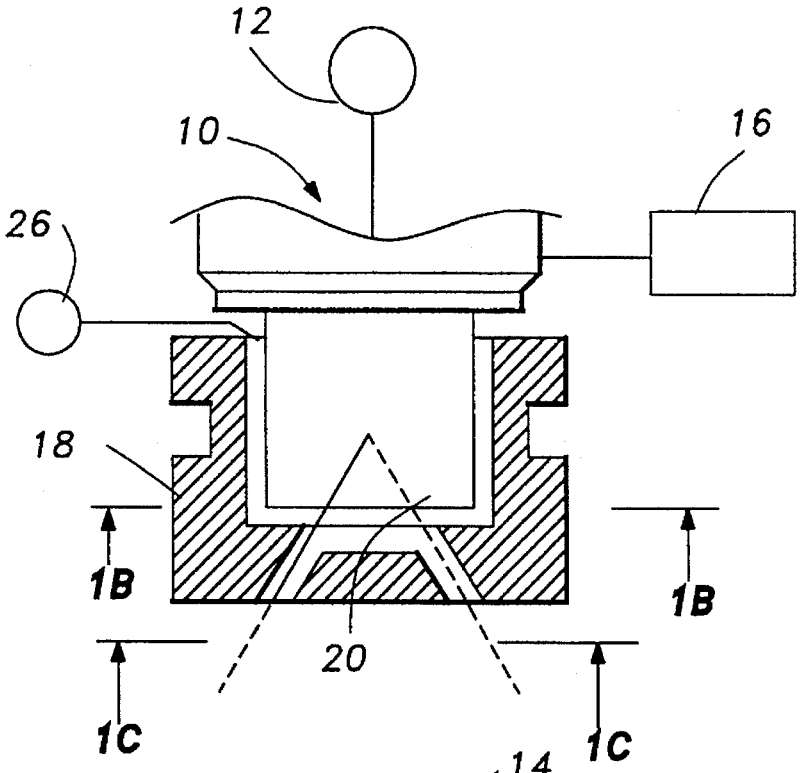
FIG. 1A is a fragmentary side view of a cold start fuel injector with an air assist tip.
Figure 1B:
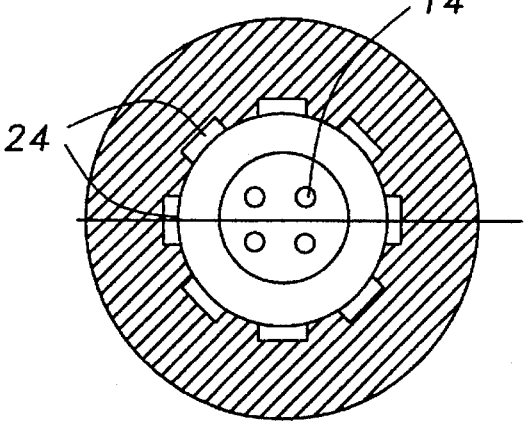
FIG. 1B is a sectional view taken substantially along line 1B—1B in FIG. 1A.
Figure 1C:
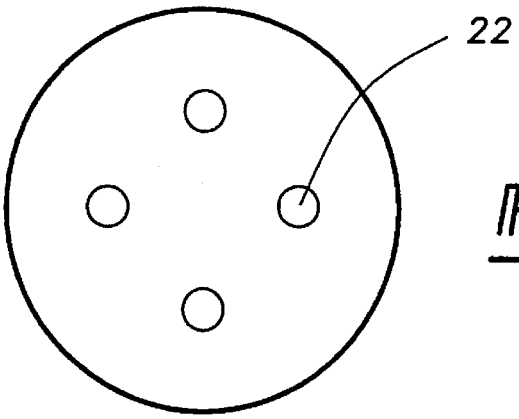
FIG. 1C is an end view taken substantially along line 1C—1C in FIG. 1A.

With reference first to FIGS. 1A–1C, a cold start injector 10 is there partially shown for supplying fuel to the internal combustion engine during a cold start operating condition. The cold start injector 10 has an inlet fluidly connected to a fuel source 12 and at least one and preferably several fuel outlets 14 (FIG. 1B). When activated by an engine control unit 16, the cold start injector 10 discharges fuel droplets out through its fuel outlets 14.

Still referring to FIGS. 1A–1C, an air assist tip 18 is preferably disposed around the outlet end 20 of the injector 10. The air assist tip 18 preferably includes outwardly flared air/fuel passageways 22 wherein one fuel passageway 22 is preferably aligned with each outlet 14 from the injector 10.

As best shown in FIG. 1B, a plurality of circumferentially spaced air assist passageways 24 are provided in the tip 18. These air assist passageways 24 are fluidly connected with a source of air 26 (FIG. 1A) so that air flows through the air assist passageways 24 and across the injector outlets 14 to enhance the atomization of the fuel from the cold start fuel injector 10. Furthermore, since the passageways 22 in the air assist tip 18 flare outwardly from each other, the air/fuel charge from the tip 18 is discharged in an outwardly flared pattern for a reason to be subsequently described.

Figure 2:
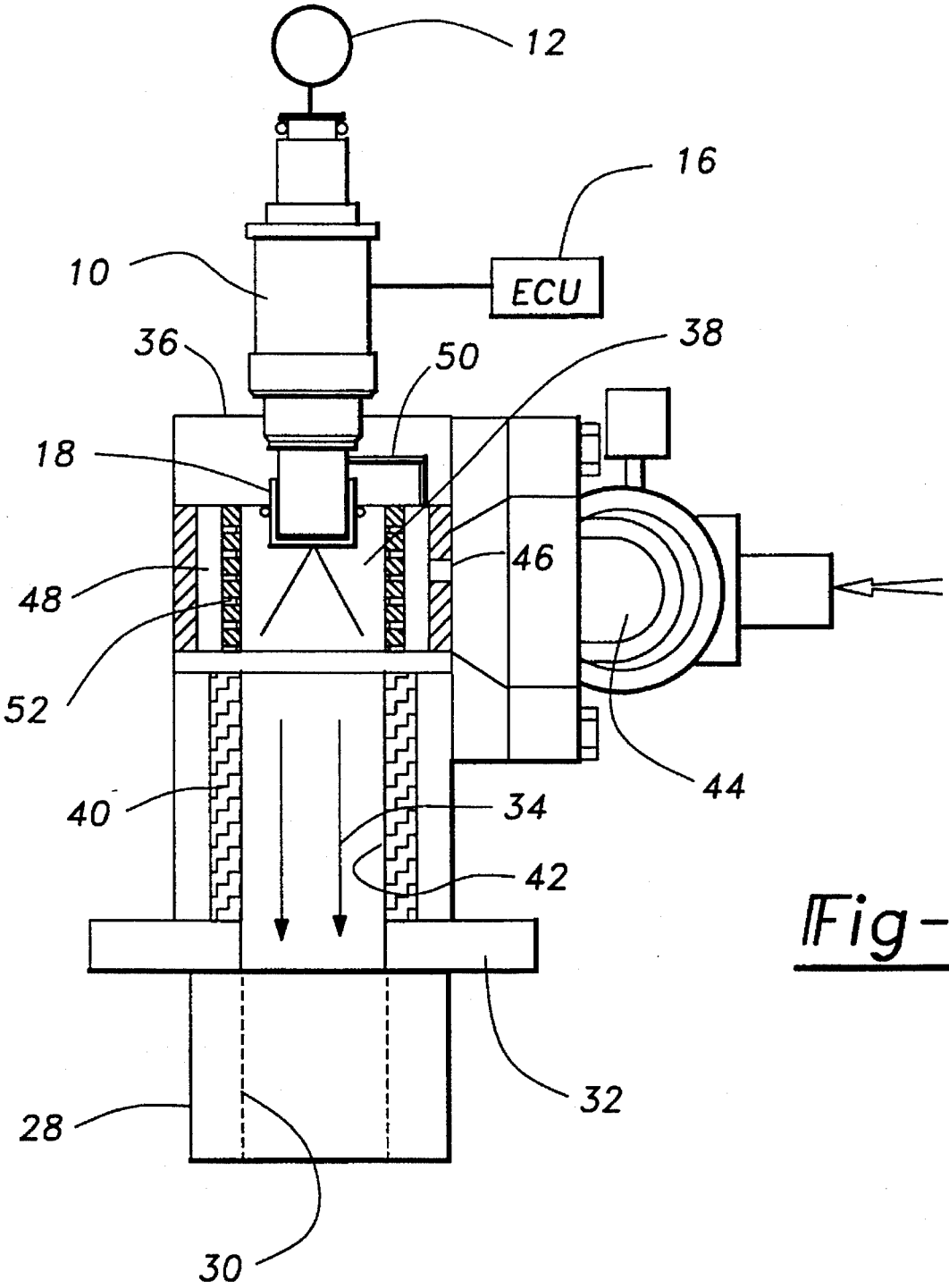
FIG. 2 is a partial sectional view illustrating a preferred embodiment of the invention.

With reference now to FIG. 2, a diagrammatic view of a first preferred embodiment of the cold start fuel control system of the present invention is there shown for use with an internal combustion engine 28 (illustrated only diagrammatically). The engine 28 includes a plurality of internal combustion chambers which receive an air/fuel charge via intake manifold 32.

An air/fuel passageway 34 is fluidly positioned in the idle bypass for the engine and is thus connected with the manifold 32. Although the air passageway 34 may be directly connected to the manifold 32 as illustrated in FIG. 2, alternatively, the passageway 34 can be formed by hoses or other tubing.

The cold start fuel injector 10 is mounted to a housing 36 at an inlet end 38 of the passageway 34. An annular heater 40 having an interior annular wall 42 is provided within the passageway 34 downstream from the fuel injector 10. Preferably, this heater 34 is a ceramic heater or equivalent which is capable of reaching a relatively high temperature, typically 160° C., in a short period of time.

In order to provide air to the air assist passageways 24 (FIG. 1B) an idle speed control valve 44 has an inlet connected to the idle speed air in the conventional fashion. An outlet 46 from the valve 44 is fluidly connected with an annular chamber 48 provided in the housing 36 immediately downstream from the cold start injector 10. This annular chamber 48 is fluidly connected by a passageway 50 formed in the housing 36 to the air assist passageways 24 (FIG. 1B). Thus, upon activation of both the valve 44 as well as the injector 10, a portion of the idle speed air flow passes through the air assist passageways 24 to assist in atomization of the fuel during its discharge from the tip 18.

Still referring to FIG. 2, a plurality of both annularly and axially spaced openings 52 are provided through the housing 36 between the annular chamber 48 and the passageway 34. Consequently, air flow into the chamber 48 also flows through the openings 52 thus swirling the air/fuel discharge from the injector 10 and ensuring that most, if not all, of the fuel droplets from the injector 10 impinge on the inner annular surface 42 of the heater 40 and are vaporized by the heater 40 prior to induction into the intake manifold 32.

Still referring to FIG. 2, the openings 52 through the housing 36 may extend simply radially through the housing 36. Alternatively, however, the openings 52 can extend both radially and tangentially with respect to the axis of the passageway 34. The tangential component of such an air flow further enhances the swirling action of the air/fuel discharge from the injector 10. Since any fuel droplets contained within the air/fuel discharge from the injector 10 are relatively heavy, the centrifugal force imposed on such fuel droplets ensures that the fuel droplets move radially outwardly and against the heater surface 42.

Figure 3A:
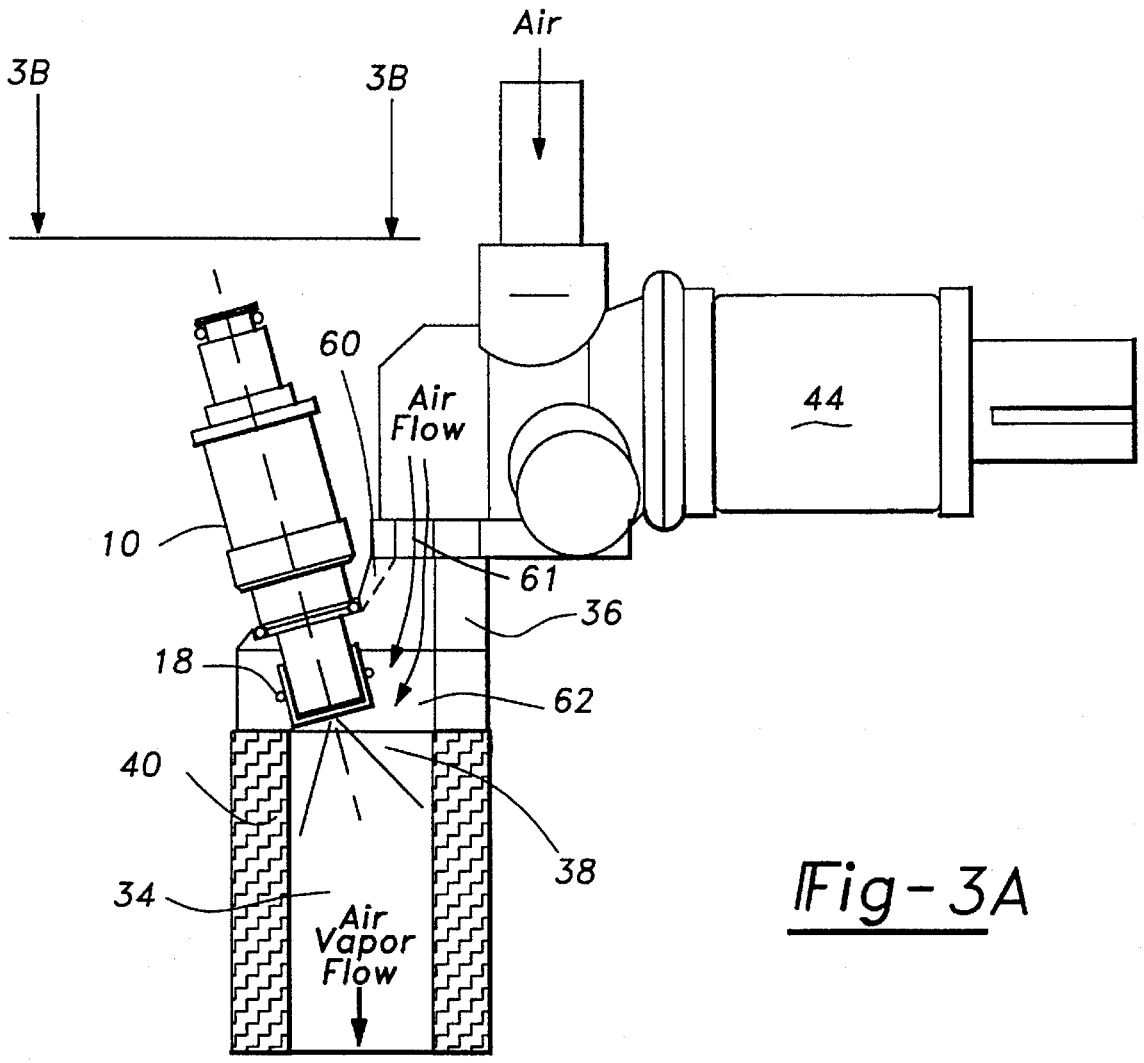
FIG. 3A is a view similar to FIG. 2 but illustrating a modification thereof.
Figure 3B:
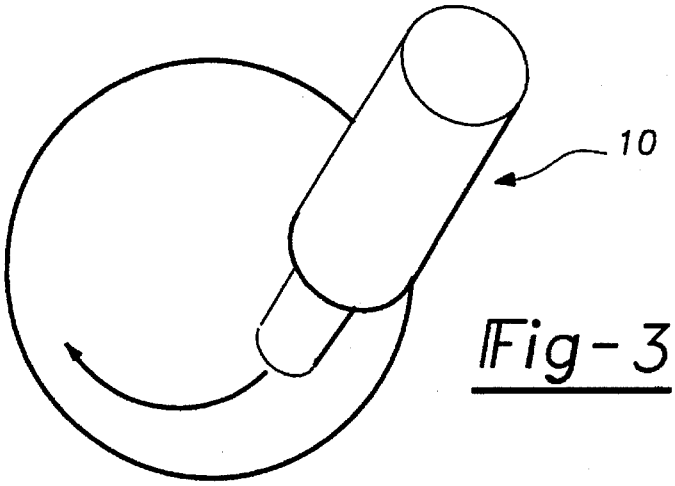
FIG. 3B is a view taken substantially along line 3B—3B in FIG. 3A.

With reference now to FIGS. 3A and 3B, a further preferred embodiment of the cold start fuel control system is there shown in which, as before, the fuel injector 10 is mounted to an inlet end 38 of the passageway 34. The outlet 61 from the valve 44 provides air upstream from the injection 10. The heater 40 is provided immediately downstream from the injector 10 while the idle speed control valve 44 provides air both to the passageway 34 as well as to the air assist inlet 24 via a passageway 60 formed in the housing 36. Thus, air flows through the passageway 34 as well as through the passageway 60 only when the valve 44 is activated.

Unlike the embodiment illustrated in FIG. 2, however, in FIG. 3 the housing 36 includes a plurality of swirl fins 62 at the inlet end 38 of the passageway 34. These fins 62 impose a swirling action on the air flow through the passageway 34 which, likewise, imposes a swirling action on the fuel droplets injected into the passageway 34 by the injector 10.

A still further difference of the embodiment illustrated in FIGS. 3A–3B is that the cold start fuel injector 10 is mounted to the housing 36 such that the injector 10 injects fuel semi-tangentially into the passageway 34. The tangential injection of the air/fuel charge from the injector 10 together with the swirling action of the air created by the fins 62 further enhances the intermixing of the fuel with the air. Additionally, the tangential injection of the fuel from the injector 10 may be either in the same direction or opposite direction from the swirling air flow created by the fins 62.

Figure 4A:
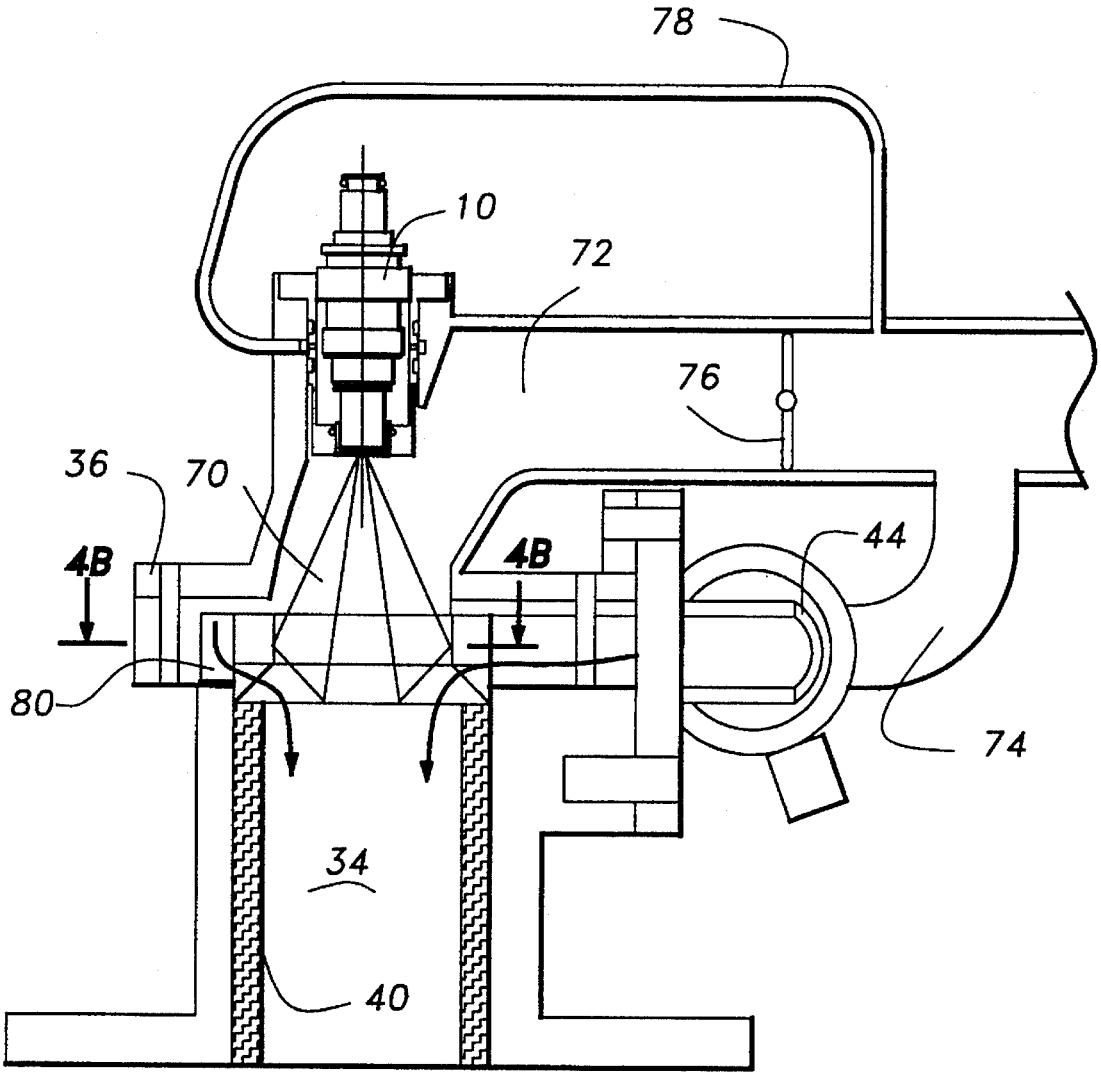
FIG. 4A is a view similar to FIG. 2 but illustrating a modification thereof.

With reference now to FIG. 4A, a still further modification of the present invention is there shown in which, unlike the previously described embodiments, the cold start fuel injector 10 discharges its air/fuel charge 70 into the main air flow passage 72 of the engine rather than the idle speed by-pass passage 74. As before, however, the heater 40 is provided downstream of the fuel injector 10 upstream from the intake manifold 32.

Still referring to FIG. 4A, the fuel injector 10 is mounted to the engine downstream from the engine throttle 76. Thus, in order to supply air to the air assist passageways 24 (FIG. 1B) a fluid conduit 78 fluidly connects the passageways 24 to the engine intake upstream from the throttle 76.

Figure 4B:
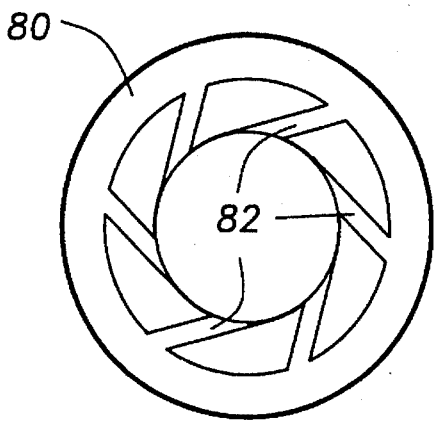
FIG. 4B is a view taken along line 4B—4B in FIG. 4A.

With reference now to FIGS. 4A and 4B, as before, in order to provide air to the engine during an idling condition, an idle speed valve 44, when activated, provides air from the idle speed by-pass 74 to an annular chamber 80 in the housing 36. The housing 36 is mounted downstream from the fuel injector 10.

As best shown in FIG. 4B, a plurality of openings 82 are provided in the housing 36 which fluidly connect the annular chamber 80 to the passageway 34. These openings 82, furthermore, are formed both radially and tangentially through the housing 36 to thereby impose a swirling action on the fuel discharge 70 from the injector 10 upstream from the heater 40.

Figure 5:
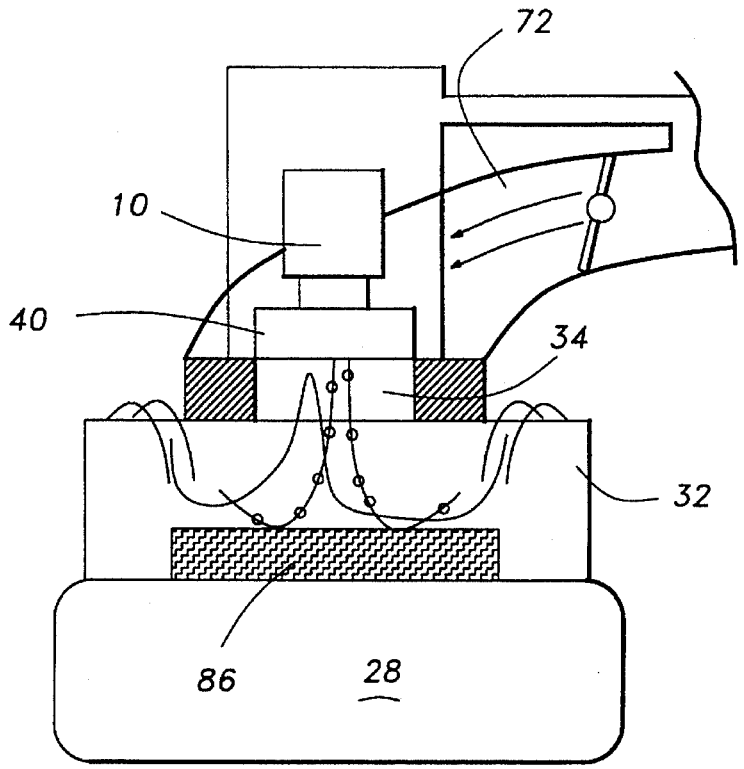
FIG. 5 is a view illustrating still a further modification of the present invention.

With reference now to FIG. 5, a still further modification of the present invention is there shown in which the cold start fuel injector 10, when activated, injects fuel through the passageway 34 and heater 40 into the intake manifold 32. In some situations, however, complete vaporization of the fuel by the heater 40 may not be possible. In this situation, a secondary heater 86 is provided within the intake manifold 32 and in alignment with the passageway 34. Thus, any fuel droplets which are not vaporized by the heater 40 impinge upon the secondary heater 86 to complete their vaporization prior to induction into the internal combustion chambers.

Preferably, the secondary heater 86 is maintained at a temperature different and preferably higher than the temperature of the heater 40. For example, if the heater 40 is maintained at substantially 160° C., the secondary heater 86 would be maintained at a higher temperature of, for example, 180° C. Such differences of temperatures for the two heaters is advantageous to ensure vaporization of the different constituents of gasoline which have different boiling points.

Still referring to FIG. 5, after repeated uses of the cold start fuel injector 10, a residue may form on the heater 40 which adversely affects the efficiency of the heater 40. Such a residue can be formed, for example, from the various components and additives in modern day fuels.

In order to clean the heater 40, the cold start injector 10 is preferably periodically activated with the heater 40 in an off condition. In this situation, the fuel flow from the cold start fuel injector 10 serves to wash and cleanse the heater 40 in the desired fashion. Furthermore, during such a washing operation, the secondary heater 86 is preferably activated to ensure vaporization of this excess fuel used during the cleaning operation.

Figure 7:
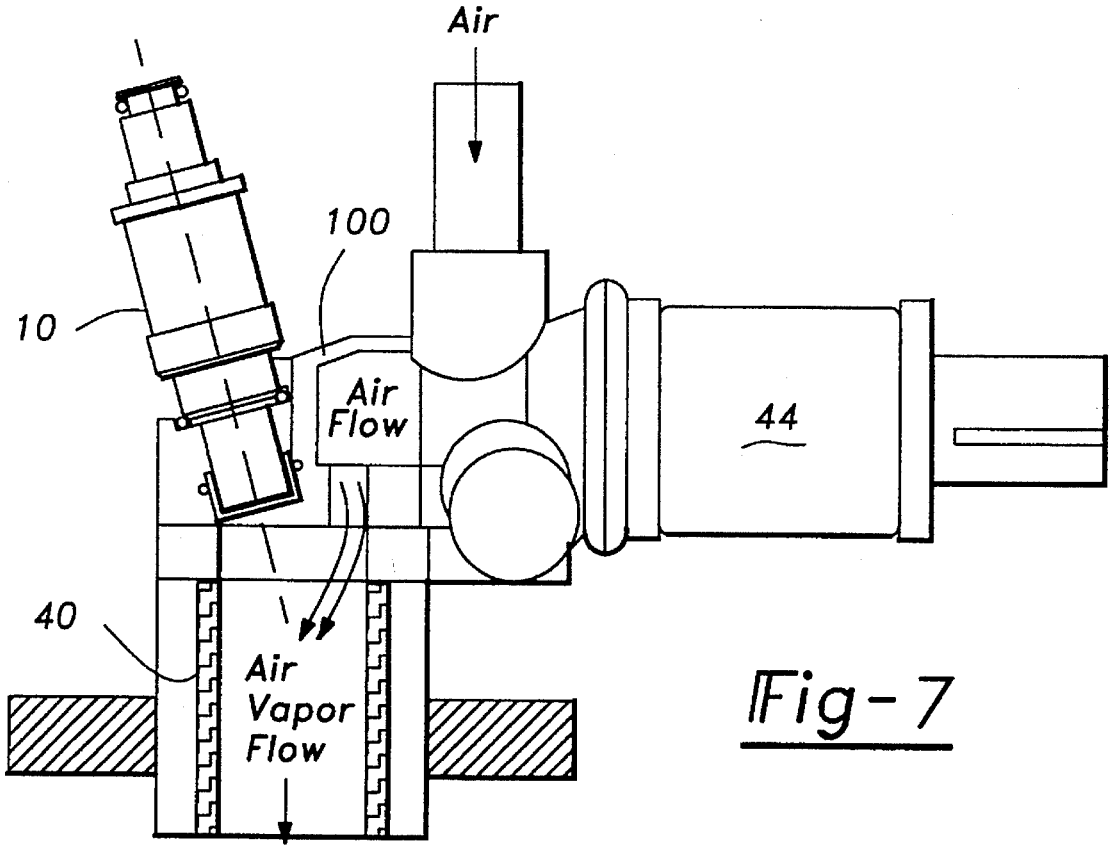
FIG. 7 is a view similar to FIG. 3A but illustrating a modification thereof.

With reference now to FIG. 7, a still further embodiment of the present invention is there shown. The embodiment of FIG. 7 is substantially identical to the embodiment of FIG. 3A except that the housing 36 includes a passageway 100 which continuously supplies air to the air assist passageways 24 independent of the valve 44.

Figure 8:
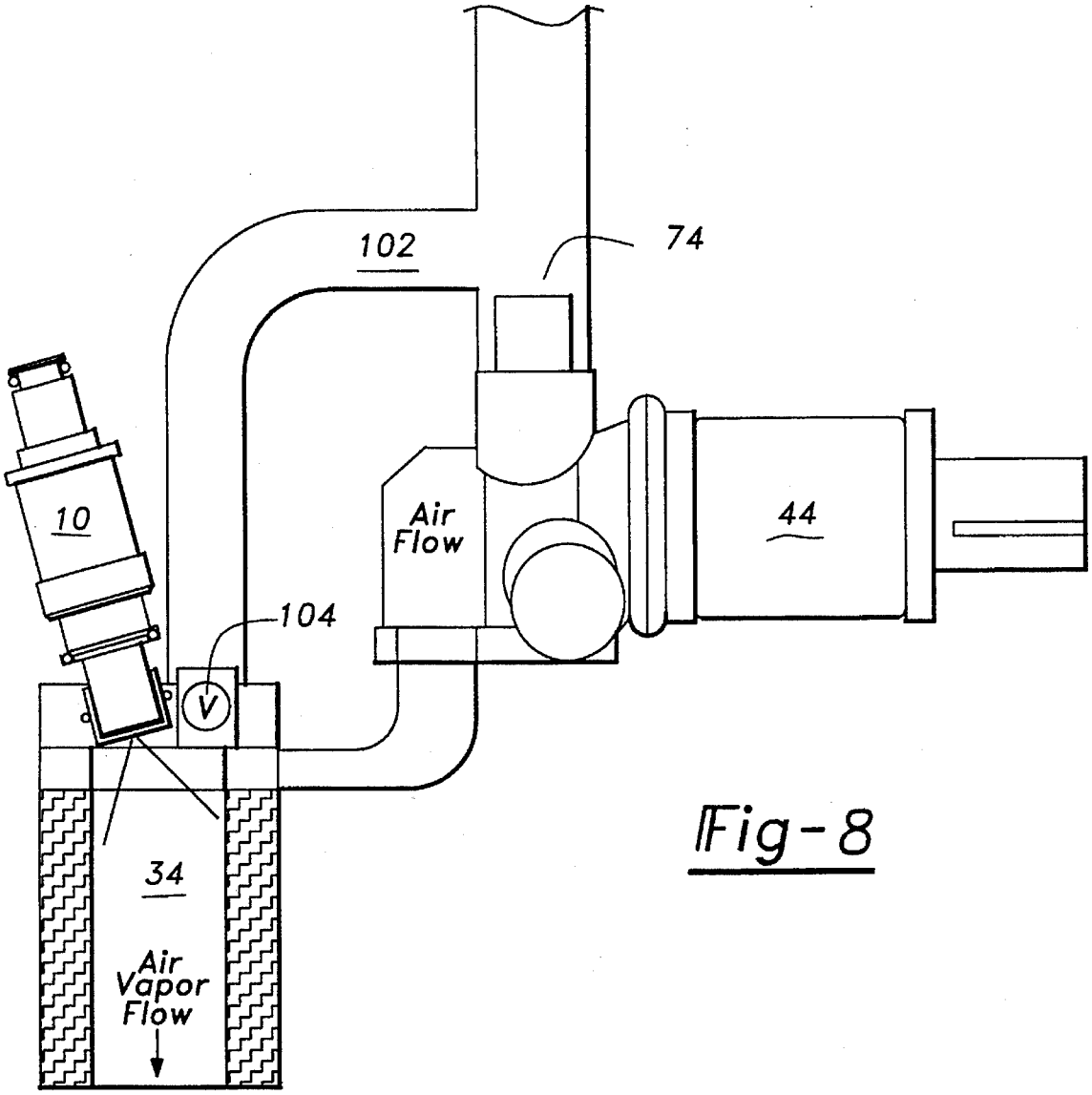
FIG. 8 is a view similar to FIG. 7 but illustrating a modification thereof.

Similarly, with reference to FIG. 8, a still further embodiment of the present invention is there shown in which an auxiliary air passageway 102 extends between the idle speed passageway 74 and the inlet end 38 of the passageway 34. Additionally, an on/off valve 104 is provided in series with the auxiliary passageway 102. Thus, when the valve 104 is activated or turned on, additional air flows from the passageway 74, through the passageway 102 and into the passageway 34. Such higher air flow may be particularly advantageous during a cold start for systems which utilize a highly retarded spark advance during cold start.

Figure 9:
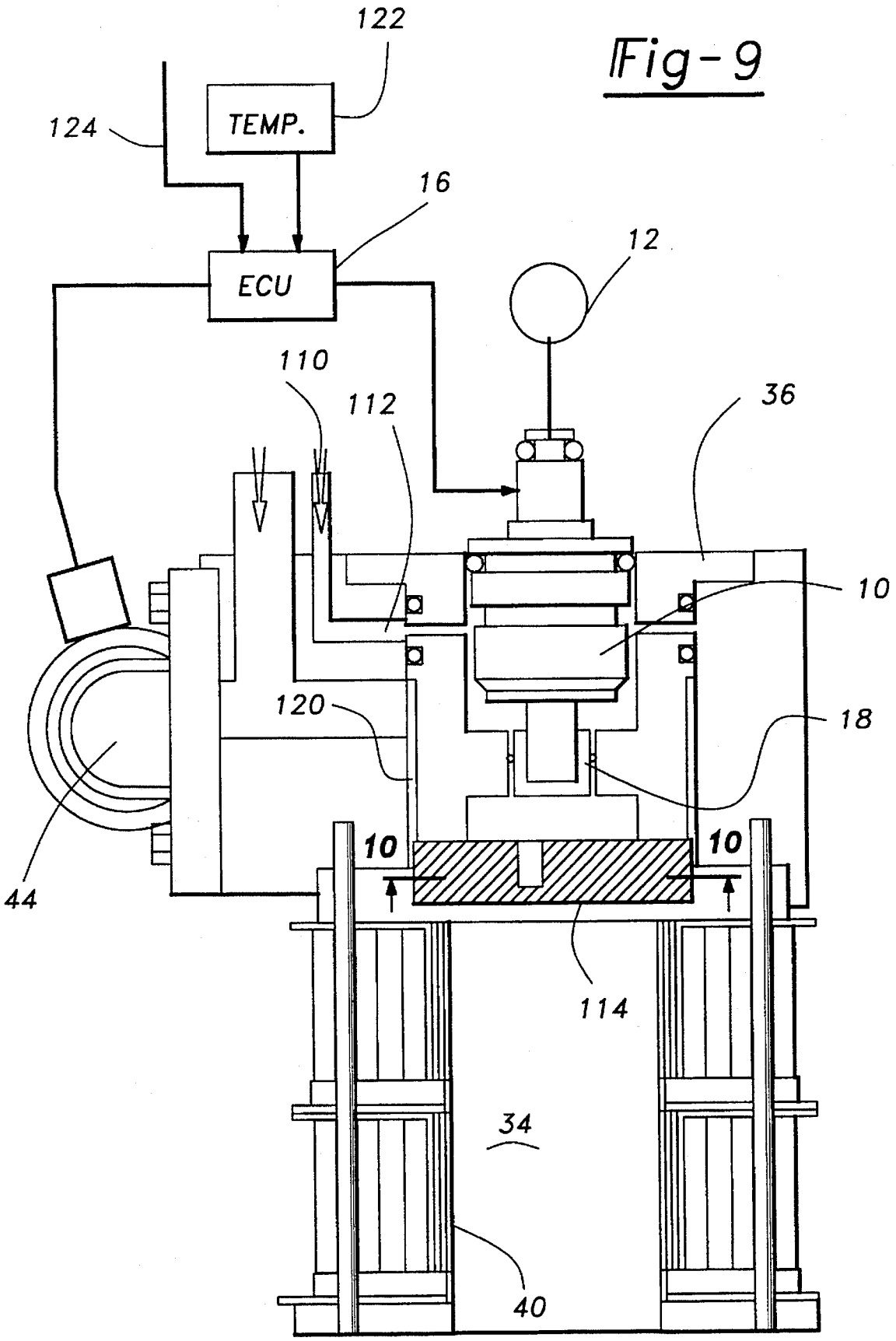
FIG. 9 is a view similar to FIG. 2 but illustrating a further modification thereof.

With reference now to FIG. 9, a still further embodiment of the present invention is there shown in which, as before, the cold start fuel injector 10 injects air through its tip 18 and into the air passageway 34. The heater 40 is provided annularly around the passageway 34 to vaporize the fuel as it impinges on the heater 40. Additionally, an air assist passageway 110 constantly provides air assist via passageway 112 in the housing 36 independent of the actuation of the valve 44. The air flow through the air assist passageway 112 passes through the air assist passageways 24 (FIG. 1B) in the previously described fashion to enhance the vaporization of the fuel discharge from the injector 10.

Figure 6:
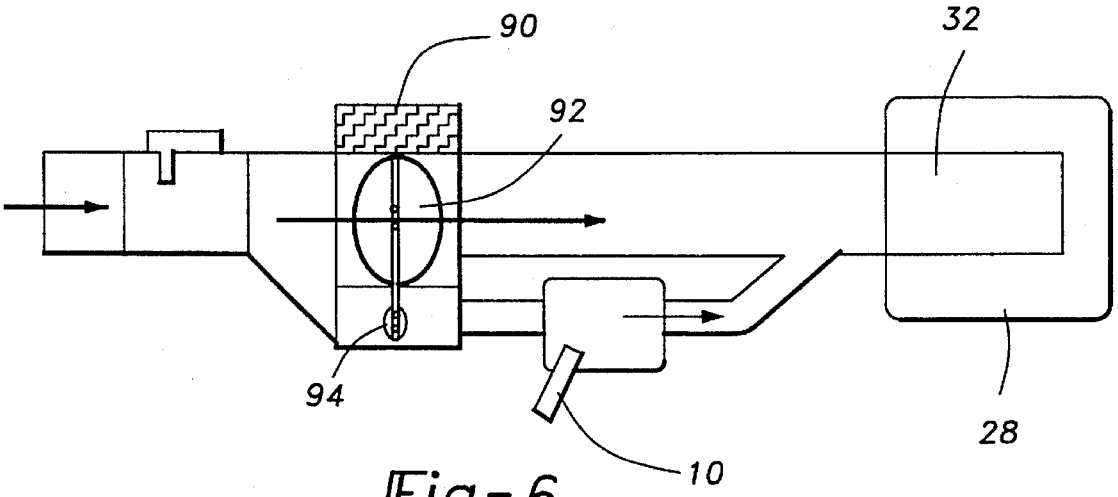
FIG. 6 is a diagrammatic view illustrating a modification of the present invention.

FIG. 6 illustrates still a further method to supply air to the cold start injection 10. In FIG. 6, an electronic throttle control 90 having a main throttle plate 92 and a second cold start/idle air flow vane plate 94 may also be provided to supply air flow to the injector 10. The secondary throttle plate 94 may be either independently controlled or progressively controlled with the main throttle plate 92.

Figure 10:
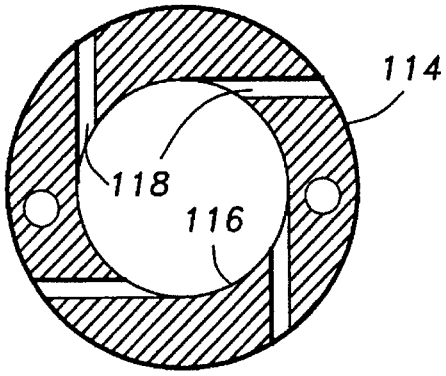
FIG. 10 is a view taken substantially along lines 10—10 in FIG. 9.

With reference now to FIGS. 9 and 10, unlike the previously described embodiments of the invention, an air/fuel mixer 114 is secured to the housing 36 immediately downstream from the fuel injector outlet and upstream of the heater 40.

The air/fuel mixer 114 is annular in shape and includes a central opening 116 (FIG. 10) through which the air/fuel discharge from the injector 10 passes. Additionally, a plurality of circumferentially spaced transverse openings 118 are formed through the mixer 114 and intersect the central opening 116 substantially tangentially. Air is supplied to the openings 118 through the idle speed control valve 44 and an air passageway 120 (FIG. 9).

With reference again to FIG. 9, the ECU 16 controls not only activation of the fuel injector 10, but also the supply of air by the idle speed control valve 44. By controlling both the activation of the fuel injector 10 and the valve 44, accurate control of the air/fuel ratio can be attained during a cold start engine condition.

In a preferred embodiment of the invention, the ECU 16 receives a signal from both a temperature sensor 122, indicative of the operating temperature of the engine, as well as an input signal on line 124 indicative of the spark advance of the engine. Thus, control of the air/fuel ratio may be attained even during a condition where the spark advance is highly retarded.

The utilization of a highly retarded spark advance during engine start up produces higher combustion temperatures. This in turn, results in a quicker warm up of the catalytic converters used in the exhaust assists for vehicles thus further reducing engine emissions.

From the foregoing, it can be seen that the present invention provides a cold start fuel control system for an internal combustion engine which achieves essentially complete vaporization of the fuel prior to its induction into the internal combustion engine chambers. Since fuel droplets are eliminated, a stoichiometric air/fuel ratio can be maintained even during a cold start engine condition thus further reducing emissions.

Having described my invention, however, many modifications thereto will become apparent to those skilled in the art to which it pertains without deviation from the spirit of the invention as defined by the scope of the appended claims.

I claim:

1. A cold start fuel control system for use with an internal combustion engine of the type having at least one combustion chamber, an air/fuel passageway fluidly connected with the combustion chamber and a source of fuel, said fuel control system comprising:

an annular heater having an interior annular wall disposed in the passageway, a cold start fuel injector having an inlet fluidly connected to said fuel source and an outlet open to said passageway such that fuel discharge from said outlet enters into an interior of said heater, means for measuring an operating temperature of the engine and for providing a temperature output signal representative, means responsive to said temperature output signal whenever said temperature output signal is less than a predetermined amount for selectively activating said cold start fuel injector and for activating said heater, means for enhancing intermixing of said fuel with said air in said passageway, said intermixing enhancing means comprising means for swirling fuel discharge from said cold start fuel injector such that at least a portion of the fuel charge impinges upon said heater interior annular wall.

2. The invention as defined in claim 1 wherein said intermixing means comprises a plurality of fins provided in said passageway, said fins being annularly spaced from each other.

3. The invention as defined in claim 1 wherein said intermixing means comprises an annular fuel mixer housing positioned in registration with said passageway, said mixer housing having an interior chamber, means for supplying air to said interior chamber, and a plurality of annularly spaced openings formed in said housing between said interior chamber and said passageway.

4. The invention as defined in claim 3 wherein said mixer housing openings extend substantially tangentially with respect to an axis of said passageway.

5. The invention as defined in claim 3 and comprising a plurality of axially spaced openings formed in said housing between said interior chamber and said passageway.

6. The invention as defined in claim 1 wherein said injector outlet discharges fuel in an outwardly flared spray pattern.

7. The invention as defined in claim 6 and comprising a spray nozzle secured to said injector across said injector outlet, said nozzle having a plurality of circumferentially spaced fuel discharge openings, said fuel discharge openings being outwardly flared from each other.

8. The invention as defined in claim 1 wherein the passageway has a longitudinal axis and wherein said injector is mounted relative to said housing such that fuel discharge from said injector outlet enters the passageway tangentially with respect to said passageway axis.

9. The invention as defined in claim 1 and comprising means for atomizing fuel discharge from said nozzle.

10. The invention as defined in claim 9 wherein said atomizing means comprises means for passing air through said fuel injector and across said fuel injector outlet.

11. The invention as defined in claim 1 wherein said intermixing means comprises means for selectively passing air through said passageway.

12. The invention as defined in claim 1 and comprising a honeycomb heater disposed across an end of said annular heater.

13. The invention as defined in claim 11 wherein said selective passing means comprises an air valve.

14. The invention as defined in claim 13 wherein said air valve comprises an electronically controlled throttle.

15. The invention as defined in claim 13 wherein said air valve comprises a variably opened valve.

16. The invention as defined in claim 13 wherein said air valve comprises an on/off air valve.

17. The invention as defined in claim 1 wherein the passageway is open to an intake manifold and comprising a manifold heater mounted in said manifold in alignment with the passageway.

18. The invention as defined in claim 16 and comprising means for activating said manifold heater so that said manifold heater is maintained at a temperature different from said annular heater.

19. The invention as defined in claim 17 wherein said manifold heater is maintained at a higher temperature than said annular heater.

20. The invention as defined in claim 1 and comprising means for selectively activating said fuel injector and deactivating said annular heater.

21. The invention as defined in claim 1 wherein the engine has a spark plug associated with combustion chamber and a spark ignition system connected to said spark plug and comprising means for controlling mass air flow through the passageway and fuel flow through said fuel injector as a function of spark ignition timing.

* * * * *